US006023891A

United States Patent [19]

Robertson et al.

[11] Patent Number: 6,023,891

[45] Date of Patent: Feb. 15, 2000

[54] LIFTING APPARATUS FOR CONCRETE STRUCTURES

[76] Inventors: Kelly Robertson, 31103 SW. French Prairie Dr., Wilsonville, Oreg. 97070; J. P. Gianotti, 2555 NW. Nicolai St., Portland, Oreg. 97210

[21] Appl. No.: 08/850,810

[22] Filed: May 2, 1997

[51] Int. Cl.[7] ..... E02D 35/00

[52] U.S. Cl. ..... 52/125.4; 411/903; 411/482

[58] Field of Search ..... 52/122.1, 125.4, 52/125.5, 124.2, 698, 699, 701; 411/903, 509, 508, 510, 482

[56] References Cited

U.S. PATENT DOCUMENTS

| | | | |
|---|---|---|---|
| 4,726,722 | 2/1988 | Wollar | 411/508 X |
| 5,011,354 | 4/1991 | Brownlee | 411/487 X |
| 5,039,267 | 8/1991 | Wollar | 411/508 |

*Primary Examiner*—Creighton Smith

*Attorney, Agent, or Firm*—Marger Johnson & McCollom, P.C.

[57] ABSTRACT

A lifting apparatus for use in lifting a concrete or other structure including a first member for inserting into a wall of the structure and a second member for fitting onto a forklift and engaging the first member. The first member includes an elongate member encased in a polymeric material. One or more resilient radial fins extend from the first member, and are angled away from the first end of the first member. A pair of raised shoulders define a circumferential channel near the second end. The first member is installed in the structure by being driven into a preformed hole in the structure. The second member includes a hollow body for sliding onto a forklift tine, and a side wall having at least one vertical recess for receiving the circumferential channel of the first member.

4 Claims, 2 Drawing Sheets

LIFTING APPARATUS FOR CONCRETE STRUCTURES

This invention relates to an apparatus for use in lifting structures made of concrete or other cast aggregate materials. In particular, the invention relates to a member which can be inserted into a pre-cast concrete structure, and which provides a point at which the concrete structure can be lifted by a forklift, for example.

Numerous methods and means are known for lifting concrete members such as precast manholes and the like. The known methods and means are, however, not ideally suited for use with pre-cast concrete structures for one or more reasons. Some must be cast into the structure during casting. Some must be removed before backfilling around the structure. Some require expensive, specialized attachments or rigging which must be mounted on a forklift or crane.

The present invention overcomes the shortcomings of the prior art by providing a lifting pin for pre-cast concrete structures which can be easily installed after manufacture of the structure, by the manufacturer or the installing contractor, and which need not be removed after the structure has been installed. The lifting pin is designed for use with a standard forklift to which has been fitted a pair of easily installed adapters. Aa an added advantage, the lifting adapters do not hinder the normal operation of the forklift, and therefore do need not be removed from the forks between lifts.

In one aspect of the invention, the lifting pin includes a body having an elongate member encased in a polymeric material. The body has first and second ends, and a first intermediate portion therebetween. In one embodiment, a plurality of radial flanges extend outwardly from the first intermediate body portion. The radial flanges are resilient, and in the preferred embodiment are angled away from the first end. In another embodiment, a single resilient radial flange is used. Surfaces define a circumferential channel adjacent the second body end. In the preferred embodiment a pair of raised, rounded circumferential shoulders define the circumferential channel. A different embodiment includes a recessed channel instead.

In another aspect of the invention, each of the pair of lifting adapter includes a hollow body which is slidable over a fork of the forklift. The lifting adapter includes a sidewall having one or more recesses for receiving the circumferential channel of the lifting pin for lifting.

These and other features of the invention will be explained in greater detail below with reference to the drawings.

DETAILED DESCRIPTION

Figure 1:
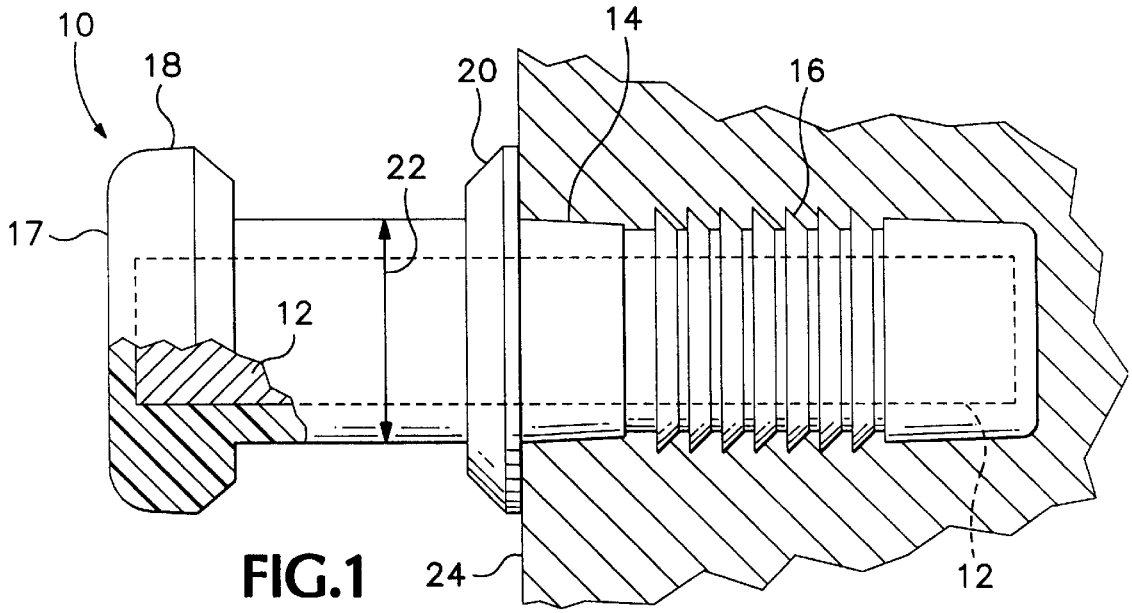
FIG. 1 is a side elevational view of a lifting pin according to the invention, and showing the encased elongate member in phantom.

A lifting member according to the invention is shown at 10. Elongate member 12 is encased in a polymeric outer covering 14. In one embodiment, elongate member 10 is a section of round reinforcing steel, or re-bar. In on embodiment, the elongate member is one-inch diameter Grade 60 reinforcing bar. Other materials of suitable strength could be used equally well, and could be of a different cross-sectional shape. The polymeric outer covering 14 is preferably polypropylene material which conforms to ASTM 4101 specifications, although those skilled in the art will recognize that other materials, including other polymeric materials could be used as well. The outer covering material is preferably selected to be compatible with injection molding equipment for economical manufacture. Tapered radial flanges 16 extend outwardly from outer covering 14. In the preferred embodiment, flanges 16 are angled away from first end 18 for ease of installation and to provide greater resistance to pulling out of the structure as described in greater detail below. Near the opposite end 17 of the member, a pair of raised shoulders 18 and 20 define a circumferential channel 22. End 17 is preferably flat to facilitate installation of the member as described below.

Figure 2:
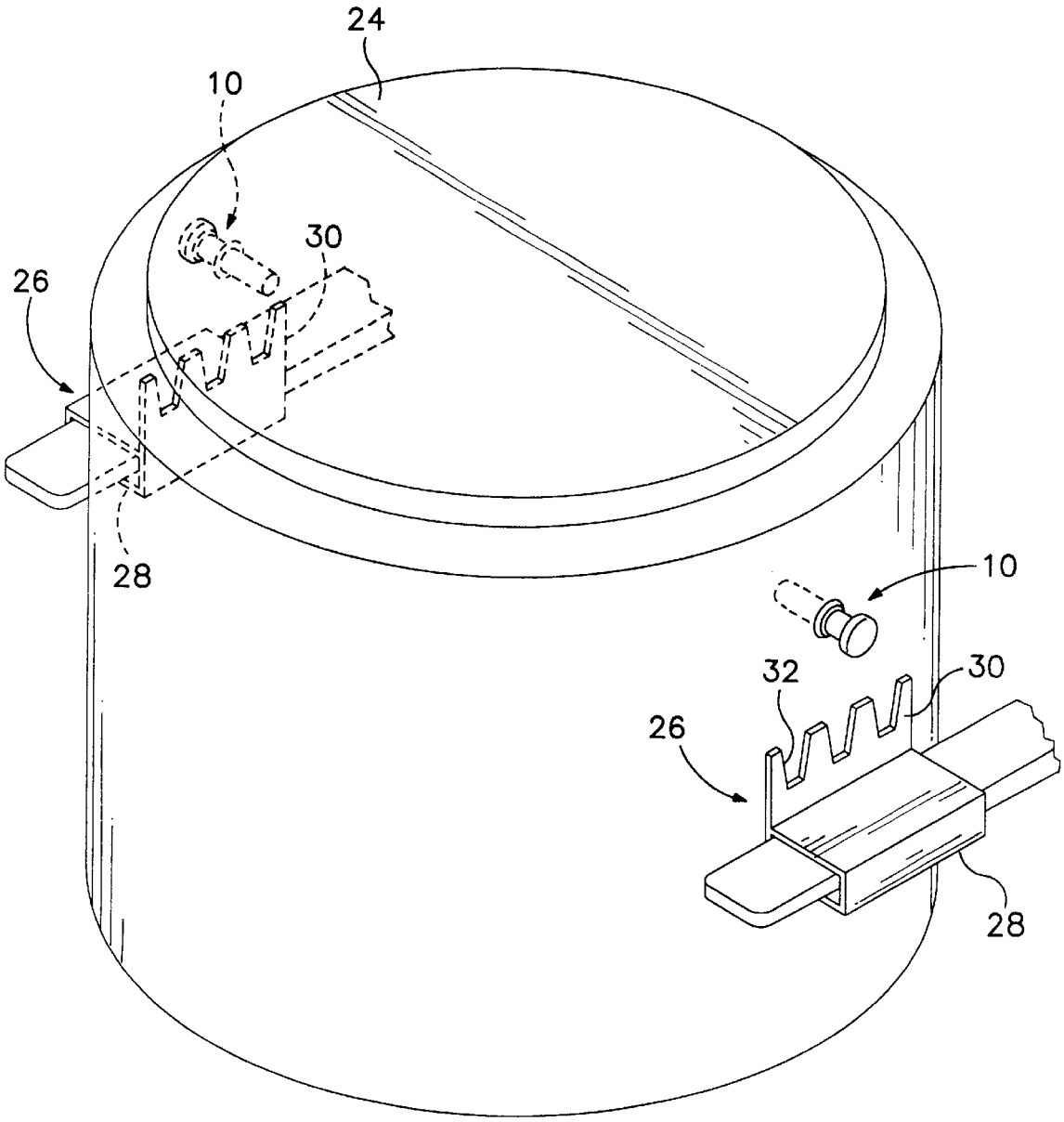
FIG. 2 is a perspective view of the lifting pin shown in FIG. 1 as installed in a precast manhole.

Although the invention as described above is round in cross-section, as best seen in FIG. 2, the invention is not limited thereto. Those skilled in the art will recognize that a lifting member according to the invention could be designed and manufactured with any of a number of cross-sectional shapes, square, rectangular, oval, hexagonal, pentagonal, or triangular for example. Accordingly, the invention is not intended to be limited only to the cross-sectional shapes described or claimed.

Referring again to FIG. 2, the lifting member is installed, in a pre-cast concrete structure 24 for example, by hammering on end 17 and driving end 18 into a suitably-sized hole in the structure. The hole's diameter is preferably slightly smaller than the diameter of the radial flanges 16. After installation, the angled radial flanges 16 engage the inner surface of the hole to resist pull out, providing a very strong and reliable lifting member. The hole is most advantageously formed during the casting process by placement of a suitable plug in the mold. If need be however, the hole could also be drilled after manufacture. In structures such as manholes, the invention finds its greatest utility where it is installed in a blind hole, since the blind hole need not be patched to ensure the watertight integrity of the manhole, or to satisfy building codes or other requirements.

Figure 3:
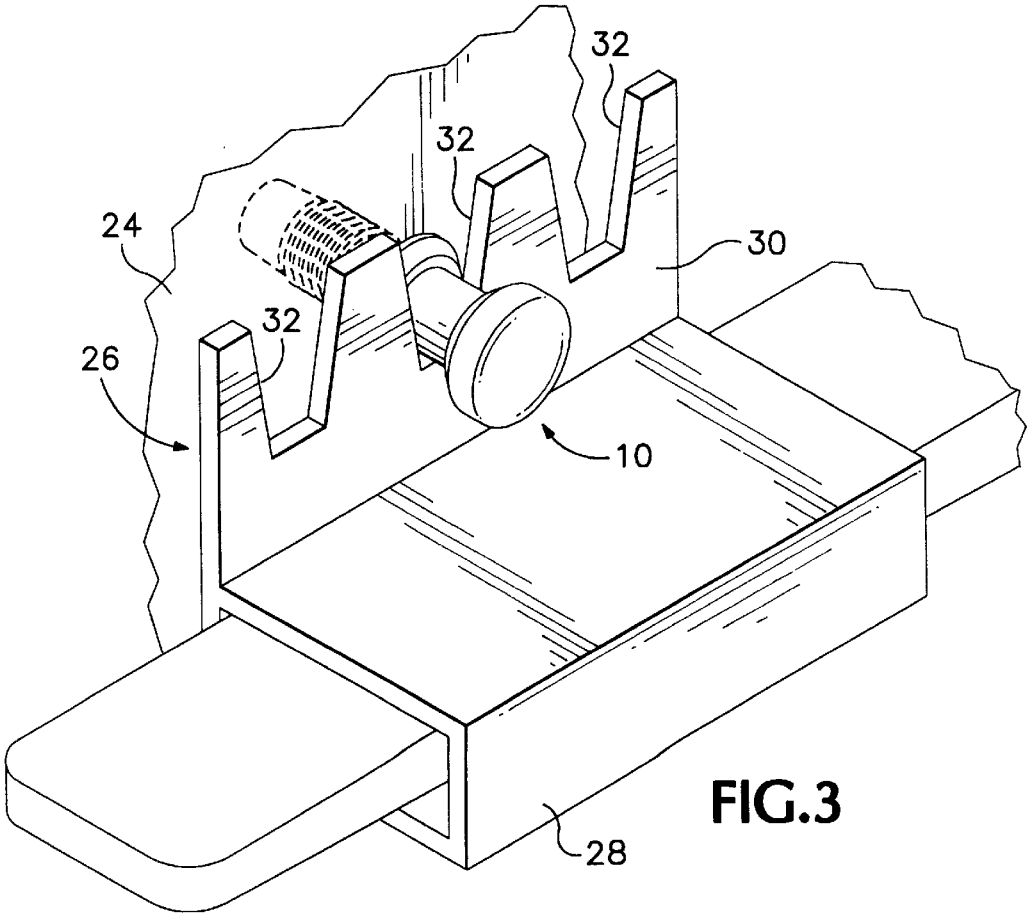
FIG. 3 is a side view of the lifting adapter fitted to the forklift, and in position to lift a precast concrete manhole in which a lifting pins as shown in FIG. 1 has been installed.

Referring to FIGS. 3 and 4, after installation of lifting pin 10, the structure 24 can be lifted using a forklift to which a lifting adapter 26 having a hollow body portion 28 has been fitted to each fork. Adapter 26 includes a side wall 30 which has one or more recesses 32 for receiving lifting pin 10 during lifting. In the embodiment shown, each adapter includes several recesses 32, allowing the forklift to approach slightly off-line and still engage the pins 10. At the same time, adapter 26 is relatively small and unobtrusive, and normally does not need to be removed from the forklift before lifting other items.

Those skilled in the art will recognize that the embodiments described above could be modified in detail and arrangement without departing from the scope of the following claims, the full scope of which is claimed.

We claim:

1. A lifting apparatus comprising:

a unitary first member including a body having an elongate member encased in a polymeric material, the body having first and second ends, and a first intermediate portion therebetween;

at least one radial flange extending outwardly from the first intermediate body portion;

surfaces defining a circumferential channel adjacent the second body end; and, a second member having a hollow body and a side wall, the side wall including surfaces defining at least on recess adapted for supportingly engaging the first member.

2. A lifting apparatus according to claim 1 wherein the at least one radial flange is a resilient flange adapted for sliding into and interlockingly engaging a bore in a concrete member.

3. A lifting apparatus according to claim 1 wherein the surfaces defining a circumferential channel include a pair of spaced apart raised channels.

4. The lifting apparatus of claim 1 wherein the at least one recess is adapted for engaging the circumferential channel of the first member.

* * * * *